US006390664B1

(12) United States Patent
Kniele et al.

(10) Patent No.: US 6,390,664 B1
(45) Date of Patent: May 21, 2002

(54) COMPULSORY MIXER USED, IN PARTICULAR, AS A CEMENT MIXER

(76) Inventors: Harald Kniele, Gemeindebeunden 10; Alexander Kniele, Gemeindebeunden 8, both of 88422 Bad Buchau (DE)

( * ) Notice: Subject to any disclaimer, the term of this patent is extended or adjusted under 35 U.S.C. 154(b) by 0 days.

(21) Appl. No.: 09/869,083

(22) PCT Filed: Sep. 29, 2000

(86) PCT No.: PCT/EP00/09562

§ 371 Date: Jun. 20, 2001

§ 102(e) Date: Jun. 20, 2001

(87) PCT Pub. No.: WO01/28672

PCT Pub. Date: Apr. 26, 2001

(30) Foreign Application Priority Data

Oct. 21, 1999 (DE) ..... 199 50 743

(51) Int. Cl.[7] ..... B01F 7/16; B01F 7/24

(52) U.S. Cl. ..... 366/293; 366/65; 366/309; 366/601; 366/296; 222/241

(58) Field of Search ..... 366/65, 66, 194, 366/195, 196, 343, 276, 279, 292, 293, 294, 296, 295, 309, 312, 601; 222/241, 240

(56) References Cited

U.S. PATENT DOCUMENTS

| | | | | | |
|---|---|---|---|---|---|
| 1,585,169 | A | * | 5/1926 | Perkins et al. | 366/309 |
| 2,209,287 | A | * | 7/1940 | Simpson | 366/296 |
| 2,298,317 | A | * | 10/1942 | Smith | 366/296 |
| 2,531,305 | A | * | 11/1950 | Smith | 222/241 |
| 2,589,583 | A | * | 3/1952 | Thompson | 222/241 |
| 2,822,934 | A | * | 2/1958 | Bartelt | 222/240 |
| 2,851,257 | A | * | 9/1958 | Morgan | 366/195 |
| 3,047,034 | A | * | 7/1962 | Sassmannshausen et al. | 222/241 |
| 3,148,802 | A | * | 9/1964 | Webb | 222/241 |
| 3,191,642 | A | * | 6/1965 | Saito | 222/241 |
| 3,248,019 | A | * | 4/1966 | Kohler | 366/196 |
| 3,251,512 | A | * | 5/1966 | Irving | 222/413 |
| 3,305,133 | A | * | 2/1967 | Parker | 222/241 |
| 3,339,896 | A | * | 9/1967 | McKibben | 366/296 |
| 3,417,968 | A | * | 12/1968 | Schlecht | 366/155.1 |
| 3,445,090 | A | * | 5/1969 | Lodige et al. | 366/295 |
| 3,602,394 | A | * | 8/1971 | McCune | 222/240 |
| 3,616,968 | A | * | 11/1971 | James et al. | 222/413 |
| 3,633,494 | A | * | 1/1972 | Schippers et al. | 100/145 |
| 3,746,315 | A | * | 7/1973 | Rizzi et al. | 366/294 |
| 3,782,642 | A | * | 1/1974 | Trafford | 222/240 |
| 3,948,421 | A | * | 4/1976 | Marchadour | 222/241 |
| 4,049,244 | A | * | 9/1977 | Hedrich | 366/192 |
| 4,164,244 | A | * | 8/1979 | Meier | 222/241 |
| 4,245,399 | A | * | 1/1981 | Muller et al. | 34/166 |

(List continued on next page.)

FOREIGN PATENT DOCUMENTS

| | | |
|---|---|---|
| DE | 31 10 437 | * 10/1982 |
| EP | 0 659 471 | * 12/1994 |
| EP | 0 796 708 | * 9/1997 |
| FR | 2 353 330 | * 12/1977 |
| GB | 214 446 | * 4/1924 |
| GB | 881 741 | * 11/1961 |

*Primary Examiner*—Tony G. Soohoo
(74) *Attorney, Agent, or Firm*—George W. Neuner; Dike, Bronstein, Roberts & Cushman, IP Group

(57) ABSTRACT

There is provided a forced mixer for mixing components, comprising a funnel-shaped mixing space having along its center axis (3) a coaxially mounted inner and outer mixing tool, the inner mixing tool (2) consisting of a screw (5) extending toward the outlet slide (6). For the forced mixer to be usable with a high efficency in particular as a concrete mixer, the outer mixing tool (8) comprises mixing shares or scrapers (9) glidingly moving along the mixing container surfaces (1) contacted by the mixed material.

8 Claims, 2 Drawing Sheets

U.S. PATENT DOCUMENTS 4,391,529 A * 7/1983 Hedrich et al. ..... 366/181.4
4,403,868 A * 9/1983 Kupka ..... 366/296
4,437,766 A * 3/1984 Joachim ..... 366/292
4,515,483 A * 5/1985 Muller et al. ..... 366/312
4,552,461 A * 11/1985 Ott et al. ..... 366/194
4,633,923 A * 1/1987 Hinzmann ..... 141/116
4,741,483 A * 5/1988 Damm et al. ..... 366/296
4,805,673 A * 2/1989 Wohrle et al. ..... 141/10
4,824,032 A * 4/1989 Johansson ..... 366/295
4,944,334 A * 7/1990 McGregor ..... 100/145
5,042,539 A * 8/1991 McGregor ..... 366/295
5,080,264 A * 1/1992 Limper ..... 222/241
5,102,229 A * 4/1992 Wada et al. ..... 366/296
5,109,894 A * 5/1992 McGregor ..... 141/128
5,122,038 A * 6/1992 Malkoski ..... 366/295
5,213,415 A * 5/1993 Saeki ..... 366/296
5,327,947 A * 7/1994 McGregor ..... 366/309
5,339,998 A * 8/1994 Warren ..... 366/293
5,518,312 A * 5/1996 Inoue et al. ..... 366/296
5,527,108 A * 6/1996 Miller ..... 366/195
5,647,665 A * 7/1997 Schuler ..... 366/196
5,718,510 A * 2/1998 Farmery et al. ..... 366/295
5,806,977 A * 9/1998 Farmery et al. ..... 366/348
5,823,667 A * 10/1998 Fukushima et al. ..... 366/65
5,908,240 A * 6/1999 Hood ..... 366/65
5,909,829 A * 6/1999 Wegman et al. ..... 222/241
5,947,169 A * 9/1999 Wegman et al. ..... 222/196
6,000,446 A * 12/1999 Wegman et al. ..... 366/196
6,196,278 B1 * 3/2001 Wegman et al. ..... 222/241
6,237,815 B1 * 5/2001 Schlosser ..... 222/241

* cited by examiner

COMPULSORY MIXER USED, IN PARTICULAR, AS A CEMENT MIXER

The invention relates to a forced mixer for producing mixtures from liquid, powdery and granular components, such as concrete mixtures.

A mixer of this type is known from DE 31 10 437 A. The outer mixing tool is formed as a worm gear which is imparted a revolving motion in a circular fashion along the mixer container wall. The inner and outer mixing screws convey in a upward direction.

It is an object of the invention to provide a mixer of the type described above which is particularly suited as a concrete mixer.

This object is achieved by a forced mixer characterised in that the outer mixing tool comprises mixing shares or mixing scrapers gliding along the mixer container surface contacted by the mixed material. While the screw of the inner mixing tool conveys the material in an upward direction, the shares or scrapers move the material in a substantially horizontal direction. As a result, it flows down more rapidly and complete intermixing takes place without any dead regions in the entire mixing container.

The centrally moving screw mixing tool feeds the mixed material in a vertical direction. As a result, the screw-conveyed mixed material is imparted a rotational motion. The outer mixing arm mixing tool counteracts this rotational motion. Due to these flows of mixed material crossing each other, a strong turbulence of the entire mixer contents and rapid and intensive intermixing are achieved.

As a further advantage of the forced mixer according to the invention, an outlet hopper is no longer needed since the mixing space may correspond to the conventional outlet hopper where a rubber hose, for example for filling a truck mixer, may be fixed using a flange. The screw mixing tool reaches all the way to the immediate vicinity of the slider arranged at the end of the outlet hopper in order to avoid non-mixed regions within the mixer.

Further embodiments of the invention are described in the dependent claims.

Referring to the figures, some embodiments of the invention are described, wherein.

Figure 1:
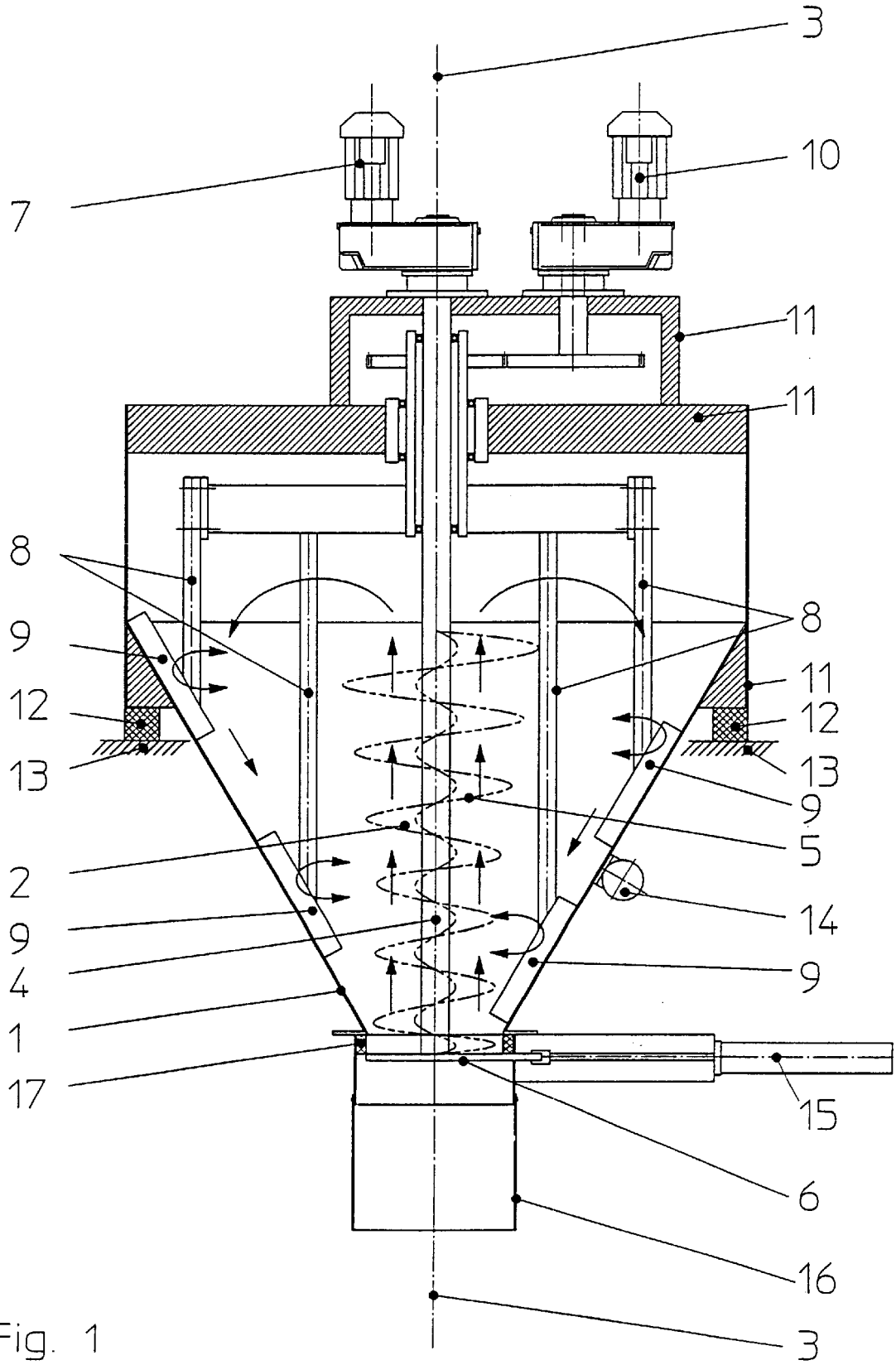
FIG. 1 is a section across a forced mixer.

In a funnel-shaped mixing container a mixing tool 2 is arranged along the center axis 3 of the mixing container 1, said mixing tool consisting of a shaft 4 and a cylindrical or conical screw 5 attached thereto or wings arranged in a screw-like fashion. This mixing tool 2 extends all the way to the immediate vicinity of the shutter slide 6 and is driven at the opposite side by a drive 7. A second mixing tool having mixing arms 8 and blades 9 attached thereto which slide across the surface of the mixing container 1 contacted by the mixed material, is mounted coaxially to the mixing tool 2 and is driven by a drive 10. Both drives 7 and 10 may also be implemented with continuous adjustment and with their direction of rotation normally being selected such that the flows of mixed material caused by them are directed in mutually opposing directions. The drives 7 and 10 as well as the mixing container 1 are attached to a support structure 11 itself connected to the installation 13 in a rigid fashion or via elastic rubber supports 12 if a vibrator 14 is supposed to be used with the mixing container 1.

The mixing container is sealed at its outlet end by means of a seal 17 and the shutter slide 6 actuated by the adjusting element 15. A tube or hose 16 is used for transferring the mixed material into shipping containers.

Figure 2:
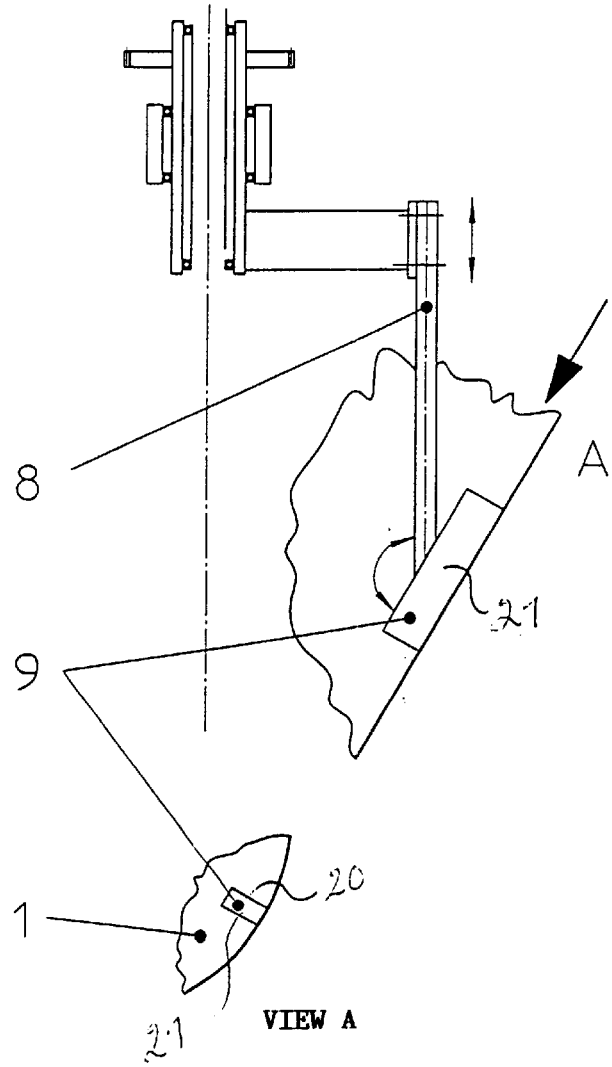
FIG. 2 is a detail from FIG. 1 with a sectional detailed representation of a scraper.

As far as the above elements 9 are referred to as blades, it should be pointed out that they are beam-like shares or scrapers. Referring to FIG. 2, an embodiment can be seen which shows that a parallelepiped-shaped body is used having a first active lateral surface in the revolving direction and an effective surface 21 in the opposite revolving direction, both surfaces 20 and 21 extending substantially in a radial direction.

This embodiment is advantageous in that the outer mixing tool is movable in both rotational directions and pushes material off the wall. The mixing arms 8 are formed such that the shares adapt to the direction of the wall with their lower side facing the container wall surface.

To that end, the mixing arms 8 and the shares 9 are adjustable in a vertical direction and at an angle with respect to the container wall.

In operation, the second mixing tool is preferably moved in intervals and alternately first in the one rotational direction and then in the other rotational direction. This will cause unmixed material which is being pushed ahead in front of the shares, to be rapidly intermixed.

Figure 3:
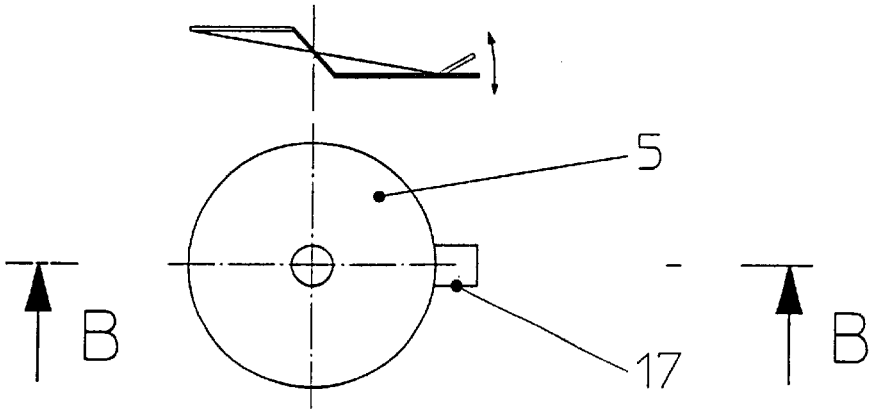
FIG. 3 is a plan view and a side elevation of a thread of the screw of the inner mixing tool.

Preferably, additional cutting elements 17 are attached to the screws in each screw plane which cutting elements may be attached in the plane of the screw or, as indicated in FIG. 3 above, inclined with respect to the screw plane. These cutting elements 17 are designed to crush lumps of the material in difficult mixing processes and generate a homogenous mixed material.

What is claimed is:

1. A forced mixer for mixing components of a mixed material, the mixer comprising: a funnel-shaped mixing container having mixing surfaces, a center axis, an outlet slide, and along its center axis a coaxially arranged an inner mixing tool and an outer mixing tool, the inner mixing tool consisting of a screw extending towards the outlet slide, wherein the outer mixing tool comprises mixing shares or scrapers glidingly moving along the mixing surfaces contacted by the mixed material, and wherein the outer mixing tool is driven at intervals and alternately between a first rotational direction and an opposite rotational direction.

2. The forced mixer as claimed in claim 1, wherein the screw of the inner mixing tool has a cylindrical shape.

3. The forced mixer as claimed in claim 1, wherein the screw of the inner mixing tool is conically shaped having a diameter increasing in an upward direction.

4. The forced mixer as claimed in any one of claims 1 through 3, characterized in that the inner mixing tool is formed by a shaft having wings arranged in a screw-type fashion.

5. The forced mixer as claimed in claim 4, further comprising cutting elements arranged at the screw or at the wings arranged on top of each other.

6. The forced mixer as claimed in claim 5, wherein both mixing tools have drives that operate at fixed RPMs.

7. The forced mixer as claimed in claim 5, wherein both mixing tools have drives that provide continuously adjustable speed.

8. The forced mixer as claimed in claim 1, wherein the mixing tools each have a drive mounted with an elastic rubber-type support and the forced mixer further comprises a vibrator attached to the mixing container.

* * * * *